US008104106B2

(12) United States Patent
Anderson

(10) Patent No.: US 8,104,106 B2
(45) Date of Patent: Jan. 31, 2012

(54) URINAL

(76) Inventor: Kenneth Fredrick Noel Anderson, Townsville (AU)

( * ) Notice: Subject to any disclaimer, the term of this patent is extended or adjusted under 35 U.S.C. 154(b) by 716 days.

(21) Appl. No.: 12/096,741

(22) PCT Filed: Dec. 6, 2006

(86) PCT No.: PCT/AU2006/001857

§ 371 (c)(1),
(2), (4) Date: Oct. 9, 2008

(87) PCT Pub. No.: WO2007/065218

PCT Pub. Date: Jun. 14, 2007

(65) Prior Publication Data

US 2009/0113615 A1 May 7, 2009

(30) Foreign Application Priority Data

Dec. 8, 2005 (AU) ..... 2005906894

(51) Int. Cl.
*E03D 11/02* (2006.01)

(52) U.S. Cl. ..... 4/429; 4/664; 4/665

(58) Field of Classification Search ..... 4/664, 665, 4/429

See application file for complete search history.

(56) References Cited

U.S. PATENT DOCUMENTS

| | | | | |
|---|---|---|---|---|
| 3,992,727 A | | 11/1976 | Elkins | |
| 4,205,403 A | | 6/1980 | Blakenship | |
| 5,687,434 A | * | 11/1997 | Tagg | 4/625 |
| 5,855,029 A | * | 1/1999 | Flippen, Sr. | 4/664 |
| 6,053,197 A | | 4/2000 | Gorges | |
| 6,370,706 B1 | * | 4/2002 | Walraven | 4/321 |
| 6,374,432 B1 | | 4/2002 | Morris | |
| 6,430,757 B1 | * | 8/2002 | Pohler | 4/321 |
| 6,507,958 B1 | * | 1/2003 | Tagg | 4/321 |
| 6,721,967 B2 | * | 4/2004 | Braxton | 4/664 |
| 6,959,723 B2 | * | 11/2005 | Gorges | 137/247.39 |

FOREIGN PATENT DOCUMENTS

| | | |
|---|---|---|
| EP | 1616518 | 1/2006 |
| GB | 2271581 | 4/1994 |

* cited by examiner

*Primary Examiner* — William V Gilbert
*Assistant Examiner* — Gisele Ford
(74) *Attorney, Agent, or Firm* — Carter, DeLuca, Farrell & Schmidt LLP

(57) ABSTRACT

A free-standing urinal (1) having: a housing (2); a trough (3) for urine; a urine collection tank (4) located within the housing (2); a drain (7) and waste trap (8) arrangement extending between the trough (3) and the tank (4); a valved outlet (28) from the tank (4); a hand wash sink (9); a drain (10) extending between the sink (9) and the trough (3); a fresh water dispenser for dispensing water into the sink (9); a paper towel dispenser (60); a paper towel waste container (70); and lifting fixtures (35, 36, 37) for moving the urinal (1) by forklift, hand or crane; The drain (7) and waste trap (8) arrangement has an "S bend" (30) containing an oily sealant (31). The urinal (1) is portable, it is freestanding and need not be mounted to a wall or other fixture, and it need not be connected to a mains water supply and sewerage system.

22 Claims, 2 Drawing Sheets

URINAL

TECHNICAL FIELD

This invention relates to a urinal. In particular, the invention concerns a freestanding urinal.

BACKGROUND ART

Commercially available urinals are typically wall-mounted as well as connected to a water supply and sewerage system. Fresh water from the water supply rinses a trough of the urinal and urine is discharged to the sewerage system by way of a drain of the urinal.

A problem with such urinals as that they cannot be used at locations where a water supply and sewerage system are not available. Another problem with such urinals is that they are not freestanding and need to be mounted to a wall or other fixture. Other problems with such urinals include that they utilise (precious) water resources, and that urine wastes and cleaning agents are discharged to drain.

It is an object of the present invention to provide a urinal which overcomes or minimises at least one of the problems mentioned above, or to provide the consumer with a useful or commercial choice.

DISCLOSURE OF INVENTION

According to the present invention, there is provided a freestanding urinal comprising:

a freestanding housing;

a trough extending within the housing;

a urine collection tank located within the housing, wherein the collection tank has an outlet and a control valve for opening and closing the outlet; and a drain and waste trap arrangement for draining urine from the trough to the collection tank and for trapping odours from the collection tank.

The housing can be of any suitable size, shape and construction. Being a freestanding urinal, it need not be mounted to a wall or other fixture. The housing can be made of any suitable material or materials, such as plastics material, fibreglass, stainless steel or vitreous china. Preferably, the housing is substantially trapezoidal in shape and has a base wall, an upstanding front wall, an upstanding rear wall, a pair of upstanding substantially trapezoidal sidewalls, and an intermediate sloping wall extending between the front, rear and side walls. One or more of the walls can be reinforced and they can be reinforced in any suitable way. For instance, the front, rear and side walls can be ribbed. Preferably, the housing is made of moulded plastics material.

The trough can be of any suitable size, shape and construction. The trough can be made of any suitable material or materials, such as plastics material, fibreglass, stainless steel or vitreous china. Preferably, the trough extends within the housing from the intermediate sloping wall. The trough can have a pair of side walls and an intermediate wall extending between the side walls. The intermediate wall can have an upper portion which extends parallel with the rear wall of the housing and a curved lower portion. Preferably, the trough is made of moulded plastics material and is integrally formed with the housing.

The urine collection tank can be of any suitable size, shape and construction. The collection tank can be made of any suitable material or materials, such as plastics material. Preferably, the collection tank has about a 250 L storage capacity. Preferably, the collection tank is located beneath the trough and is defined by at least some of the walls of the housing and trough, as well as perhaps one or more upstanding walls within the housing. The collection tank can have an inlet for urine. The outlet of the collection tank is preferably connectable to a pump such that the collection tank can be drained of urine. The outlet can be connected to the pump in any suitable way, but preferably involves a quick (male outlet to female hose) coupling. The outlet can be in the form of a camlock fitting.

The urinal can have a valve/vent allowing the introduction of air into the collection tank when the collection tank is being evacuated of urine under vacuum. Such a valve/vent can be, for instance, located in a wall of the housing.

Any suitable type of control valve for opening and closing the outlet can be used. The control valve is preferably a tap that can be moved by hand between the open and closed positions.

The drain and waste trap arrangement can be of any suitable size, shape and construction, and can be made of any suitable material or materials. Preferably, the arrangement extends from the curved lower portion of the intermediate wall of the trough to the inlet of the collection tank. The arrangement can comprise one or more pipes of any suitable shape. The waste trap can comprise an "S bend" of sorts. The waste trap can further comprise a liquid sealant through which urine can pass but through which odours cannot pass. Such waste traps having an "S bend" and a liquid (oily) sealant are sold in cartridge form under the trade mark Sloan® Waterfree by Sloan Valve Company. Preferably, an upper end of the waste trap is in fluid communication with the trough and a pipe of the arrangement extends from a lower end of the waste trap to the inlet of the collection tank.

The urinal can have lifting fixtures enabling it to be lifted, for example, by hand, crane or forklift. For instance, recessed areas of the base wall can provide entry points for a fork of a forklift. A handle fixed to each side wall of the housing can enable the urinal to be lifted by hand. One or more openings in each side wall of the housing can serve as attachment points for a crane.

The urinal can have wheels such that it can be transported from one location to another. The urinal can have a wheeled frame or wheels (eg. castor wheels) mounted to the base wall.

The urinal can further comprise at least one fluid dispenser for dispensing fluid such as water, detergent and/or antiseptic hand wash solution (e.g. an evaporative solution containing ethanol).

The urinal can further comprise a hand wash sink, at least one fluid dispenser for dispensing fluid such as water or detergent into the sink, and a drain for draining fluid from the sink to the trough.

Preferably, the urinal comprises a hand wash sink, a water dispenser for dispensing water into the sink, and a drain for draining water from the sink to the trough.

The sink can be of any suitable size, shape and construction. The sink can be made of any suitable material or materials, such as plastics material. Preferably, the sink extends within the housing from the intermediate sloping wall. Preferably, the sink has a pair of side walls and an intermediate wall extending between the side walls. The intermediate wall of the sink can have an upper portion which extends parallel with the rear wall of the housing and a curved lower portion from which extends the drain. Preferably, the side walls of the sink and the housing extend parallel with one another. Preferably, the sink is made of moulded plastics material and is integrally formed with the housing.

The drain can be of any suitable size, shape and construction, and can be made of any suitable material or materials. Preferably, the drain is a passage which extends through adjacent side walls of the sink and the trough, such that water within the sink can drain into the trough.

The water dispenser can be of any suitable size, shape and construction. Preferably, the water dispenser comprises a water reservoir, a feeder pipe for feeding water to the sink, and a pump for pumping water from the reservoir to the feeder pipe.

The water reservoir can be of any suitable size, shape and construction. The reservoir can be made of any suitable material or materials, such as plastics material. Preferably, the reservoir has about a 40 to 60 L storage capacity and is located within the housing. The reservoir can have an inlet for receiving fresh water from an external source and an outlet connected to the pump.

Any suitable type of pump can be used. The pump can be driven manually or by motor. Preferably, the pump is foot-operated. Preferably, a foot-operated lever of the pump is located within a recess in the front wall of the housing.

The feeder pipe can be of any suitable size, shape and construction. Preferably, the feeder pipe has an inlet connected to the pump and an outlet located adjacent to the intermediate wall of the sink. The rear wall of the housing can have a vertically extending groove and the feeder pipe can extend within the groove.

The urinal can further comprise a paper towel dispenser and a paper towel waste container. The paper towel dispenser and the paper towel waste container can be of any suitable size, shape and construction, and can be made of any suitable material or materials. Preferably, the paper towel dispenser is connected to the intermediate wall of the sink above the outlet of the feeder pipe. Preferably, the paper towel waste container is located adjacent to the sink and extends from the intermediate sloping wall within the housing. Preferably, the paper towel waste container is made of moulded plastics material and is integrally formed with the housing.

The housing can have one or more ports or doors for accessing internal components of the urinal, such as the pump, water reservoir, collection tank, drain and waste trap.

The urinal can have a privacy screen such that the urinator is provided with privacy when urinating. Any suitable type of privacy screen can be used and can be connected to the housing in any suitable way. Preferably, the privacy screen extends from the front wall or intermediate sloping wall around or partway around the urinator.

A preferred embodiment of the invention will now be described by way of example with reference to the accompanying figures.

BEST MODE FOR CARRYING OUT THE INVENTION

Figure 1:
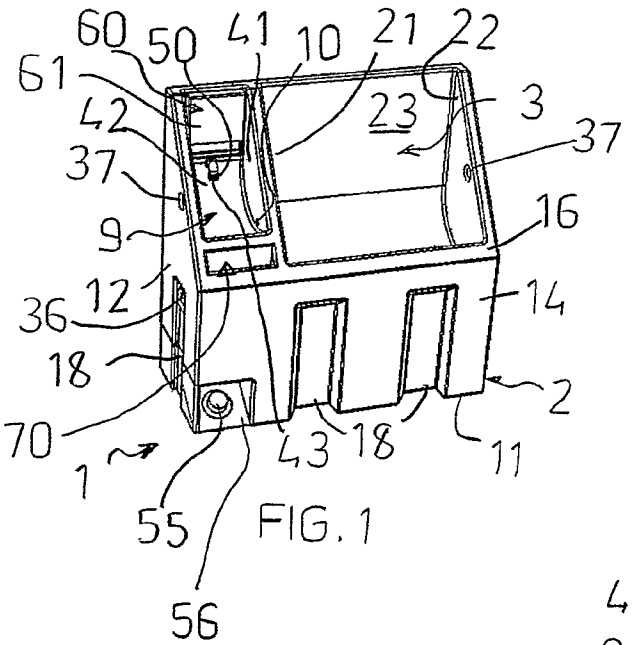
FIG. 1 is a front perspective view of a freestanding urinal, according to an embodiment of the invention.

In the figures, like reference numerals refer to like features.

Figure 3:
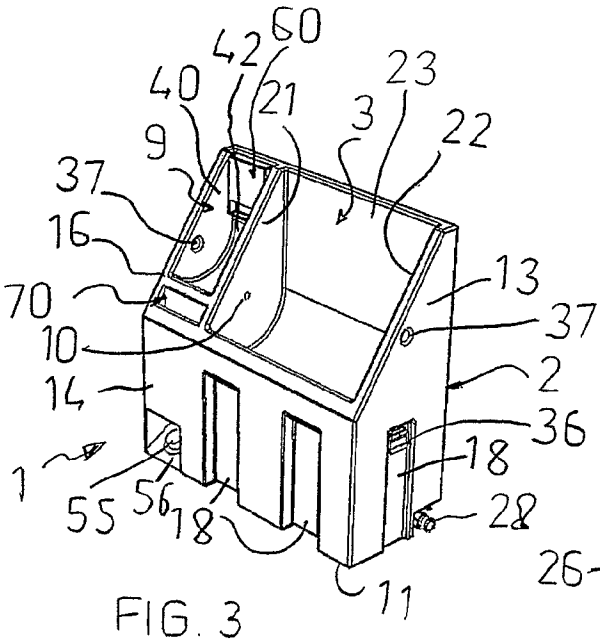
FIG. 3 is another front perspective view of the urinal shown in FIG. 1.
Figure 5:
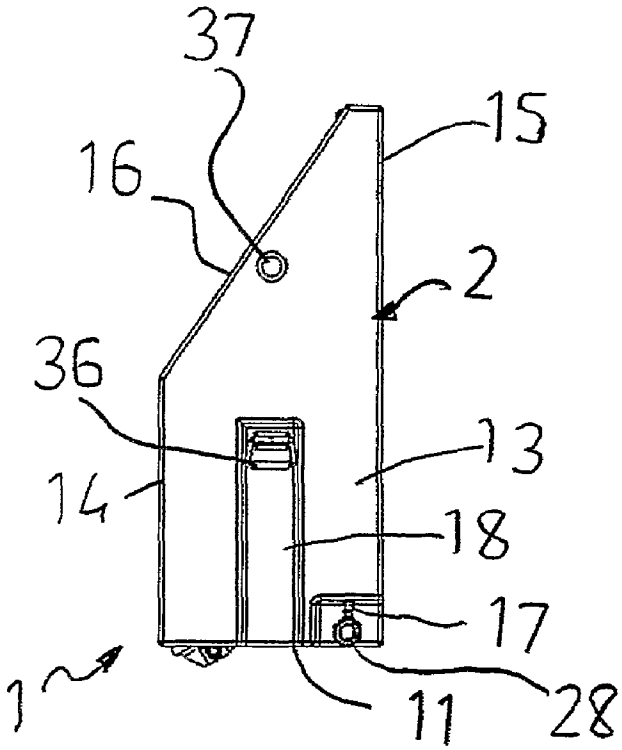
FIG. 5 is a side elevation view of the urinal shown in FIG. 1.

The figures show a urinal 1 having a housing 2, a trough 3, a urine collection tank 4 (see FIG. 6), a drain 7 and waste trap 8 arrangement (see FIG. 6), a tap 17 (see FIG. 5), a hand wash sink 9, a drain 10 (see FIG. 3), lifting fixtures, and a fresh water dispenser for dispensing water into the sink 9.

The housing 2 is substantially trapezoidal and comprises a base wall 11, a pair of upstanding substantially trapezoidal side walls 12, 13, an upstanding front wall 14, an upstanding rear wall 15, and an intermediate sloping wall 16. The housing 2 is reinforced by way of recessed areas 18 of the front and side walls 12, 13, 14. Access ports and doors (not shown) of the housing 2 provide access to internal components, such as the drain 7, the waste trap 8 and collection tank 4.

The trough 3 extends within the housing 2 from the intermediate sloping wall 16. The trough 3 has a pair of side walls 21, 22 and an intermediate wall 23. The intermediate wall 23 has an upper portion which extends parallel with the rear wall 15 of the housing 2 and a curved lower portion from which extends an upper end 25 of the drain 7 and waste trap 8 arrangement.

Figure 6:
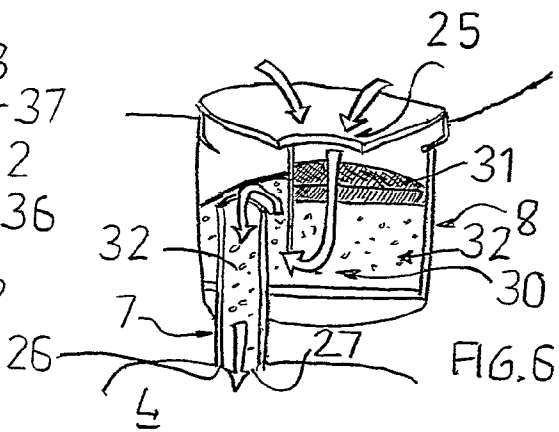
FIG. 6 is a sectional view of part of the urinal shown FIG. 1.

Referring now to FIG. 6, the urine collection tank 4 is located within the housing 2 below the trough 3 and has about a 250 L storage capacity. Walls of the tank 4 are defined by the walls 11, 13, 14, 15 of the housing 2 and the intermediate wall 23 of the trough 3, as well as by one or more upstanding walls that extend between the front 14 and rear 15 walls of the housing 2. The tank has an inlet 27 at a lower end 26 of the drain 7 and waste trap 8 arrangement. The tank has an outlet 28 that can be opened and closed using the tap 17. The outlet 28 is in the form of a camlock fitting and is connectable to a pump (not shown), such that the tank 4 can be drained of urine.

As seen in FIG. 6, the drain 7 and waste trap 8 arrangement has an "S bend" 30 of sorts containing an oily sealant 31. Such a waste trap 8 is sold in cartridge form under the trade mark Sloan® Waterfree by Sloan Valve Company. The direction of flow of urine 32 through the drain 7 and water trap 8 arrangement is indicated in FIG. 6 by way of arrows.

Figure 4:
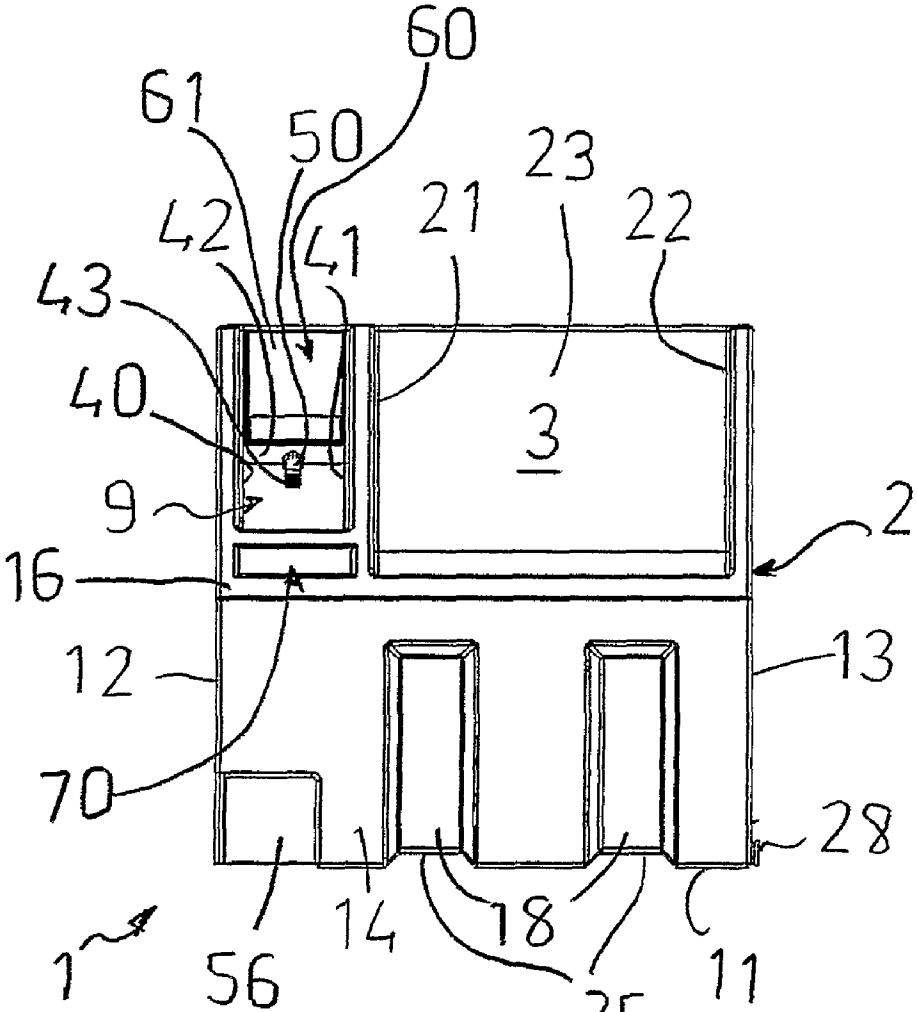
FIG. 4 is a front elevation view of the urinal shown in FIG. 1.

The urinal 1 has lifting fixtures enabling it to be lifted, for example, by hand, crane or forklift. Recessed areas 35 (see FIG. 4) of the base wall 11 provides entry points for a fork of a forklift. A handle 36 mounted to each side wall 12, 13 enables the urinal 1 to be lifted by hand. An opening 37 in each side wall 12, 13 serves as an attachment point for a crane.

The sink 9 extends within the housing 2 from the intermediate sloping wall 16. The sink 9 has a pair of side walls 40, 41 and an intermediate wall 42. The intermediate wall 42 has an upper portion which extends parallel with the rear wall 15 of the housing 2 and a curved lower portion from which extends the drain 10. The drain 10 is an opening which extends through adjacent side walls 41, 21 of the sink 9 and the trough 3. The drain 10 allows water from within the sink 9 to drain to the trough 3.

The water dispenser comprises a water reservoir (not shown), a feeder pipe 50 for feeding water to the sink 9, and a foot-operated pump that, when operated, pumps water from the reservoir to the feeder pipe 50.

The reservoir has about a 40 to 60 L storage capacity and is located within the housing 2 beneath the sink 9. The foot-operated pump is also located within the housing 2. A foot-operated lever 55 of the pump is located within a recess 56 in the front wall 11 of the housing 2. The reservoir has an outlet connected to the pump. An inlet enables the reservoir to be replenished with fresh water.

Figure 2:
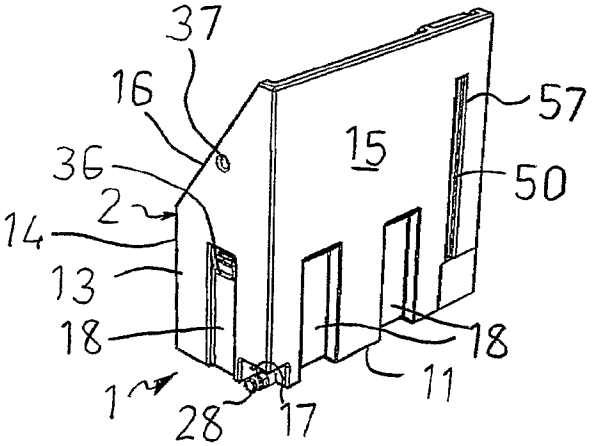
FIG. 2 is a rear perspective view of the urinal shown in FIG. 1.

The feeder pipe 50 has an inlet connected to the pump and an outlet 43 located adjacent the intermediate wall 42 of the sink 9. The rear wall 15 of the housing 2 has a vertically extending groove 57 and a part of the feeder pipe 50 extends within the groove 57 (see FIG. 2).

The urinal 1 further comprises a paper towel dispenser 60 and a paper towel waste container 70. The paper towel dispenser 60 has a rectangular housing 61 connected to the intermediate wall 42 of the sink 9 above the feeder pipe outlet 43. Paper towel is dispensed through a slot in the housing 61. The waste container 70 is rectangular and extends from the intermediate sloping wall 16 into the housing 2.

The housing 2, trough 3, collection tank 4, sink 9 and waste container 70 are formed from moulded plastics material.

In use, the urinal 1 is transported to the desired location by hand or using a forklift truck or crane, using one or more of the lifting fixtures 35, 36, 37. The water reservoir is filled with fresh water. The collection tank 4 is sealed by closing the outlet 28 with the tap 17 and by placing oily sealant 31 within the waste trap 8. A urinator stands adjacent the front wall 11 and directs his urine stream into the trough 3. The urine drains into the collection tank 4 by way of the drain 7 and waste trap 8 arrangement. The urinator may then place his hands within the sink 9 and pump water onto his hands using the foot-operated lever 55. The urinator may then dry his hands with paper towels from the dispenser 60 and dispose of the towels in the waste container 70. In order to empty the collection tank 4 of urine, a hose of a pump is coupled to the outlet 18 and the tap 17 is opened. If necessary, the urinal 1 can have a valve/vent allowing the introduction of air into the collection tank 4 when the collection tank 4 is being evacuated of urine under vacuum.

Advantages of the urinal as exemplified include that it is portable, it is freestanding and need not be mounted to a wall or other fixture, and it need not be connected to a mains water supply and sewerage system. Hence, the urinal can be used at remote locations or at other locations where plumbing is not available or feasible. Moreover, since it is essentially a dry sanitation system, water resources can be conserved and disposal of liquid wastes into waterways can be avoided.

The foregoing embodiments are illustrative only of the principles of the invention, and various modifications and changes will readily occur to those skilled in the art. The invention is capable of being practiced and carried out in various ways and in other embodiments. It is also to be understood that the terminology employed herein is for the purpose of description and should not be regarded as limiting.

The term "comprise" and variants of the term such as "comprises" or "comprising" are used herein to denote the inclusion of a stated integer or stated integers but not to exclude any other integer or any other integers, unless in the context or usage an exclusive interpretation of the term is required.

The invention claimed is:

1. A freestanding urinal comprising:

a freestanding housing including a base wall, a pair of generally upstanding sidewalls, a generally upstanding front wall, a generally upstanding rear wall, and an intermediate wall defining a sloped configuration; said front wall having a height less than said rear wall, said intermediate wall connecting upper edges of said front and rear walls; said base wall, front wall, and intermediate wall defining a substantially trapezoidal cross section;

a trough extending within the housing, the trough defined between the intermediate wall and a trough wall disposed within the housing;

a urine collection tank located within the housing and defined by the base, side, front and rear walls of the housing and the trough wall, wherein the collection tank has an outlet and a control valve for opening and closing the outlet; and a drain and waste trap arrangement for draining urine from the trough to the collection tank and for trapping odors from the collection tank.

2. The urinal of claim 1, wherein the trough wall comprises an upper portion which extends parallel with the rear wall of the housing and a curved lower portion.

3. The urinal of claim 1, wherein the collection tank has about a 250 L storage capacity.

4. The urinal of claim 1, wherein the outlet of the collection tank is connectable to a pump such that the collection tank can be drained of urine.

5. The urinal of claim 1, wherein the control valve is a tap that is moved by hand between the open and closed positions.

6. The urinal of claim 1, wherein an upper end of the drain and waste trap arrangement is in fluid communication with the trough and a lower end of the drain and waste trap arrangement extends to an inlet of the collection tank.

7. The urinal of claim 6, wherein the drain and waste trap arrangement comprises an S-bend containing a liquid sealant through which urine can pass but through which odors cannot pass.

8. The urinal of claim 1 further comprising a hand wash sink, a liquid dispenser for dispensing liquid into the sink, and a drain for draining liquid from the sink to the trough.

9. The urinal of claim 8, wherein the sink extends within the housing from the intermediate wall and comprises a pair of side walls and an intermediate wall extending between the side walls.

10. The urinal of claim 9, wherein the intermediate wall of the sink comprises an upper portion which extends parallel with the rear wall of the housing and a curved lower portion from which extends the drain of the sink.

11. The urinal of claim 9, wherein the drain of the sink is a passage which extends through adjacent said side walls of the sink and the trough.

12. The urinal of claim 8, wherein the liquid dispenser comprises a liquid reservoir, a feeder pipe for feeding liquid to the sink, and a pump for pumping liquid from the reservoir to the feeder pipe.

13. The urinal of claim 12, wherein the water has about a 40 to 60 L storage capacity and is located within the housing.

14. The urinal of claim 13, wherein the reservoir has an inlet for receiving fresh liquid from an external source and an outlet connected to the pump.

15. The urinal of claim 12, wherein the pump is foot-operated.

16. The urinal of claim 15, wherein a foot-operated lever of the pump is located within a recess in the front wall of the housing.

17. The urinal of claim 9 further comprising a paper towel dispenser and a paper towel waste container, wherein the paper towel dispenser is connected to the intermediate wall of the sink above the outlet of the feeder pipe, and the paper towel waste container is located adjacent to the sink and extends from the intermediate wall within the housing.

18. The urinal of claim 1 further comprising lifting fixtures enabling the urinal to be lifted by hand, crane or forklift.

19. The urinal of claim 18, wherein recessed areas of the base wall provide entry points for a fork of a said forklift.

20. The urinal of claim 18, wherein a handle fixed to each side wall of the housing enables the urinal to be lifted by hand.

21. The urinal of claim 18, wherein an opening in each said side wall of the housing serves as an attachment point for a crane.

22. The urinal of claim 1, wherein said housing, trough and collection tank are integrally formed via molding of plastics material.

* * * * *